US007351111B2

(12) United States Patent
Cheng

(10) Patent No.: US 7,351,111 B2
(45) Date of Patent: Apr. 1, 2008

(54) MULTI-ACCESSORY ADAPTOR FOR A VEHICLE

(75) Inventor: Hsu-Cheng Cheng, Tucheng (TW)

(73) Assignee: Tang Yang Dies Co., Ltd., Taipei (TW)

( * ) Notice: Subject to any disclaimer, the term of this patent is extended or adjusted under 35 U.S.C. 154(b) by 0 days.

(21) Appl. No.: 11/650,585

(22) Filed: Jan. 8, 2007

(65) Prior Publication Data

US 2007/0249216 A1 Oct. 25, 2007

(30) Foreign Application Priority Data

Feb. 9, 2006 (TW) ..... 95202271 U

(51) Int. Cl.
*H01R 25/00* (2006.01)

(52) U.S. Cl. ..... 439/638; 439/668

(58) Field of Classification Search ..... 439/638, 439/668

See application file for complete search history.

(56) References Cited

U.S. PATENT DOCUMENTS 4,248,494 A * 2/1981 McDonald et al. ..... 439/638
D359,269 S * 6/1995 Wharton ..... D13/144
5,593,323 A * 1/1997 Dernehl ..... 439/668
6,612,875 B1 * 9/2003 Liao ..... 439/675

* cited by examiner

*Primary Examiner*—Tho D. Ta
(74) *Attorney, Agent, or Firm*—Troxell Law Office, PLLC

(57) ABSTRACT

The present invention discloses a multi-accessory adaptor for a vehicle, comprising a power plug portion, which is a cylindrical inserting rod disposed with a positive inserting pole protruding from its front end cover and two negative spring plates on its opposing sides and penetrating therethrough, and a connection cord is connected to the positive and negative poles, respectively, and protrudes out from the rear of the inserting rod; and a socket portion, which is a hollow housing with its front and rear inserting slots for the insertion and retainment of the positive and negative plates, respectively, the positive and negative plates coupled with their corresponding connection cords, and the negative plate on the rear shaped to form at least two plate holes for the insertion of their corresponding cylindrical sockets which are then secured at the rear opening of the housing.

10 Claims, 8 Drawing Sheets

MULTI-ACCESSORY ADAPTOR FOR A VEHICLE

FIELD OF THE INVENTION

The present invention relates to a power adaptor and in particular to a multi-accessory adaptor for a vehicle suitable for the space in a vehicle.

BACKGROUND OF THE INVENTION

The power socket has been a basic accessory for vehicles nowadays to meet the demand of drivers and passengers. There are increasing demands, apart from as a cigarette lighter, for other in-car electronic devices, CD or mobile charging kit, for example. Consequently, conventional power plugs have to be plugged into the cigarette lighter socket to acquire power.

The conventional power plug (cigar or cigarette lighter plug) extends a pole from its center and two stretching spring plates on the two sides of the external ring of the protruding pole as the other pole. The two poles are connected to the respective pole in the cigarette lighter socket to form a closed circuit. It is usually a direct current of 12V.

There is only one socket present in one vehicle at the moment. Therefore, the cigarette lighter is inserted into the socket for lighting a cigarette, and the further use of other electronic device, a handsfree mobile phone for example, can be only done by unplugging the cigarette lighter first and then the power plug of the electronic device may be inserted for power.

The present applicant has filed an "one-to-two multi-accessory adaptor for a vehicle" and approved to be bulletined as the Taiwanese publication No. 539301, which can render the cigarette lighter socket to be used for the cigarette lighter and other power plugs. The head cover of the aforementioned invention is rotatable left and right for the insertion of the cigarette lighter and other power plug for power. It has been favorably received among customers. However, simplifying the welding process to enhance environmental conservation and reduce assembly procedure is the best way to cut down manufacturing cost.

SUMMARY OF THE INVENTION

To meet such a demand, the applicant having a long time experience in designing, production, and marketing of the cigarette lighter proposes the present invention, multi-accessory adaptor for a vehicle, as a result of numerous trials and experiments.

An object of the present invention is to provide a multi-accessory adaptor for a vehicle, comprising a power plug portion, which is a cylindrical inserting rod disposed with a positive inserting pole protruding from its front end cover and two negative spring plates on its opposing sides and penetrating therethrough, and a connection cord is connected to the positive and negative poles, respectively, and protrudes out from the rear of the inserting rod; and a socket portion, which is a hollow housing with its front and rear inserting slots for the insertion and retainment of the positive and negative plates, respectively, the positive and negative plates coupled with their corresponding connection cords, and the negative plate on the rear shaped to form at least two plate holes for the insertion of their corresponding cylindrical sockets which are then secured at the rear opening of the housing.

Another object of the present invention is to provide a multi-accessory adaptor for a vehicle, wherein the cylindrical inserting rod is formed by connecting two semi-circular covers face-to-face and a metal cover sealing the opening the connected covers; the housing is formed by connecting two housing covers face-to-face.

Yet another of the present invention is to provide a multi-accessory adaptor for a vehicle, wherein the rear end of the inserting rod extends to form an axial connection mechanism and the front end of the housing is disposed with a pivoting mechanism to be axially connected to the axial connection mechanism, such that the inserting rod may be angularly adjusted with respect to the housing, wherein the axial connection mechanism is an axial connection plate at the rear end of the inserting rod with its external edge forming a plurality of engaging slots on its side protruding laterally to form an axial tube; and the pivoting mechanism is disposed with a slot between the two axial walls on the front center in the lower housing cover for the insertion of the axial connection plate and for the straddling of the lateral axial tube onto the two axial slots pre-formed on the two axial walls, and the rear of the two axial walls are vertically disposed with a stop wall and their front is protrudingly disposed with an engaging tenon to be engaged with one of the engaging slot of the axial connection plate.

Still yet another object of the present invention is to provide a multi-accessory adaptor for a vehicle, wherein the positive inserting pole and the negative spring plate are connected with a respective connection cord, which penetrates through the laterally axial tube of the axial connection plate, and the positive inserting pole and a metal resilient body at its rear are disposed with a fuse therebetween and the metal resilient body is further coupled with a connection cord.

Still another object of the present invention is to provide a multi-accessory adaptor for a vehicle, wherein the cylindrical sockets may all be in the shape of short circular tube; or one of them is the existing cigarette lighter socket assembly and the rest are short circular tube, and wherein the rear opening of the short circular tube protrudes to form a rim, which can be clampingly accommodated within the rear opening of the housing, and the cigarette lighter socket assembly may pass through the plate hole and its connection portion on its front end is connected to the through hole pre-shaped on the positive plate so as to achieve a secured fastening.

Still yet another object of the present invention is to provide a multi-accessory adaptor for a vehicle, further comprising a display device, a display device having a through hole on the for the insertion of a light channeling seat and then a lighting device pressed to be retained in the light channeling seat with its two legs bended and straddled on the positive plate and negative plate, respectively, to form a closed circuit and the lighting device may be a single LED light or a multi-color LED light.

BRIEF DESCRIPTION OF THE DRAWINGS

The present invention can be more fully understood by reference to the following description and accompanying drawings, in which.

DETAILED DESCRIPTION OF THE INVENTION

Figure 1:
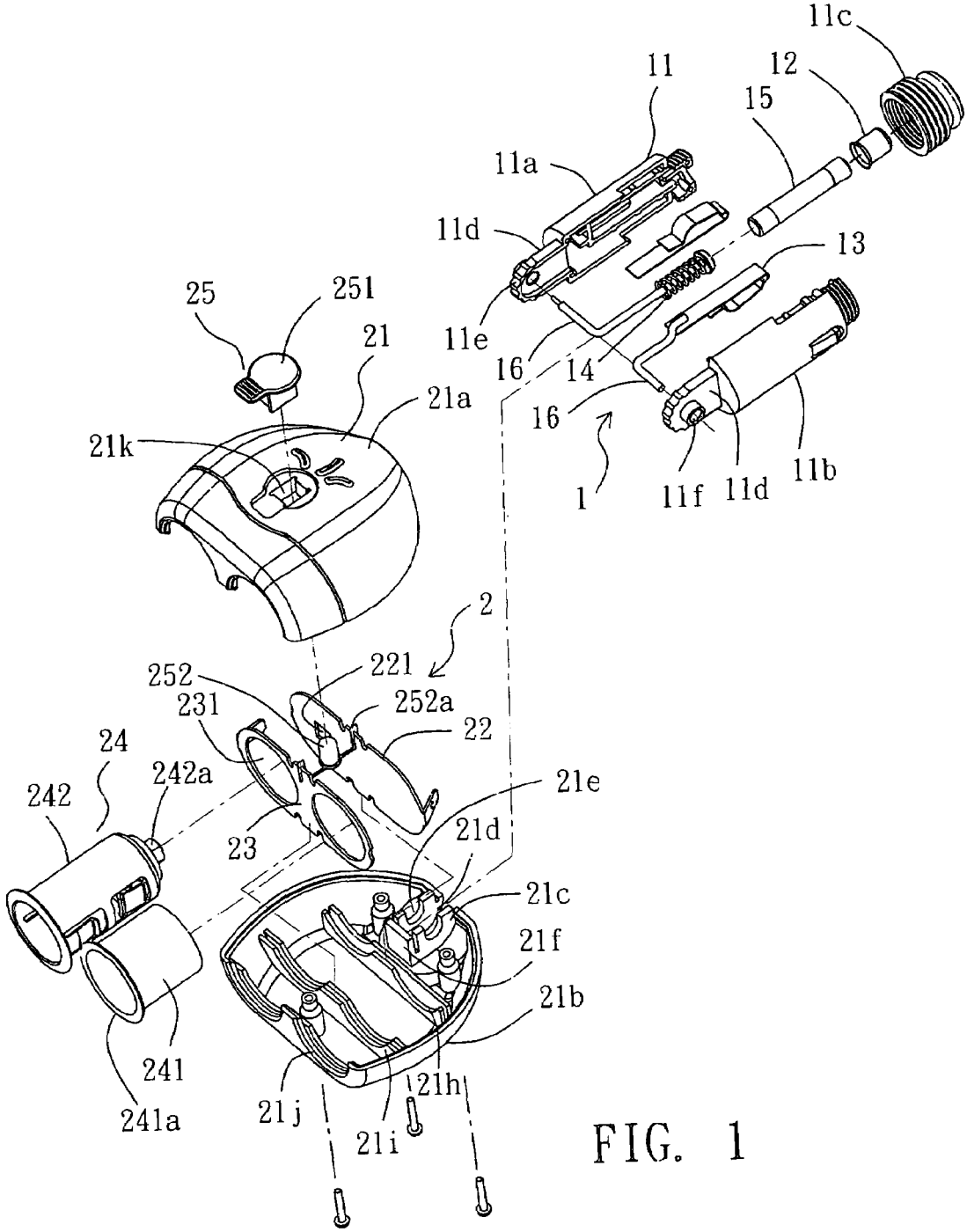
FIG. 1 schematically illustrates an exploded perspective view of a multi-accessory adaptor for a vehicle according to the present invention.
Figure 2:
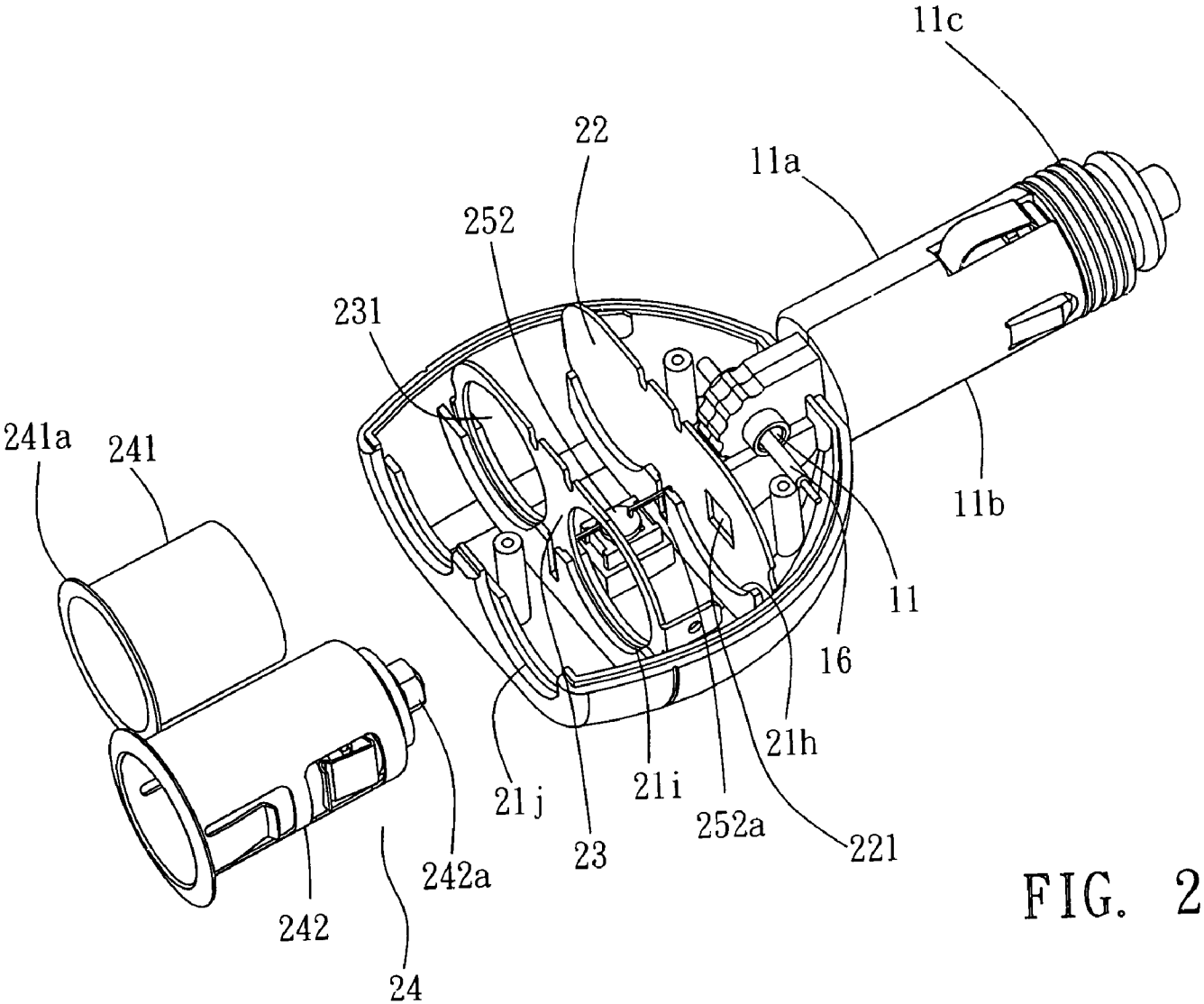
FIG. 2 schematically illustrates a perspective view of a multi-accessory adaptor for a vehicle without the lower cover according to the present invention.
Figure 3:
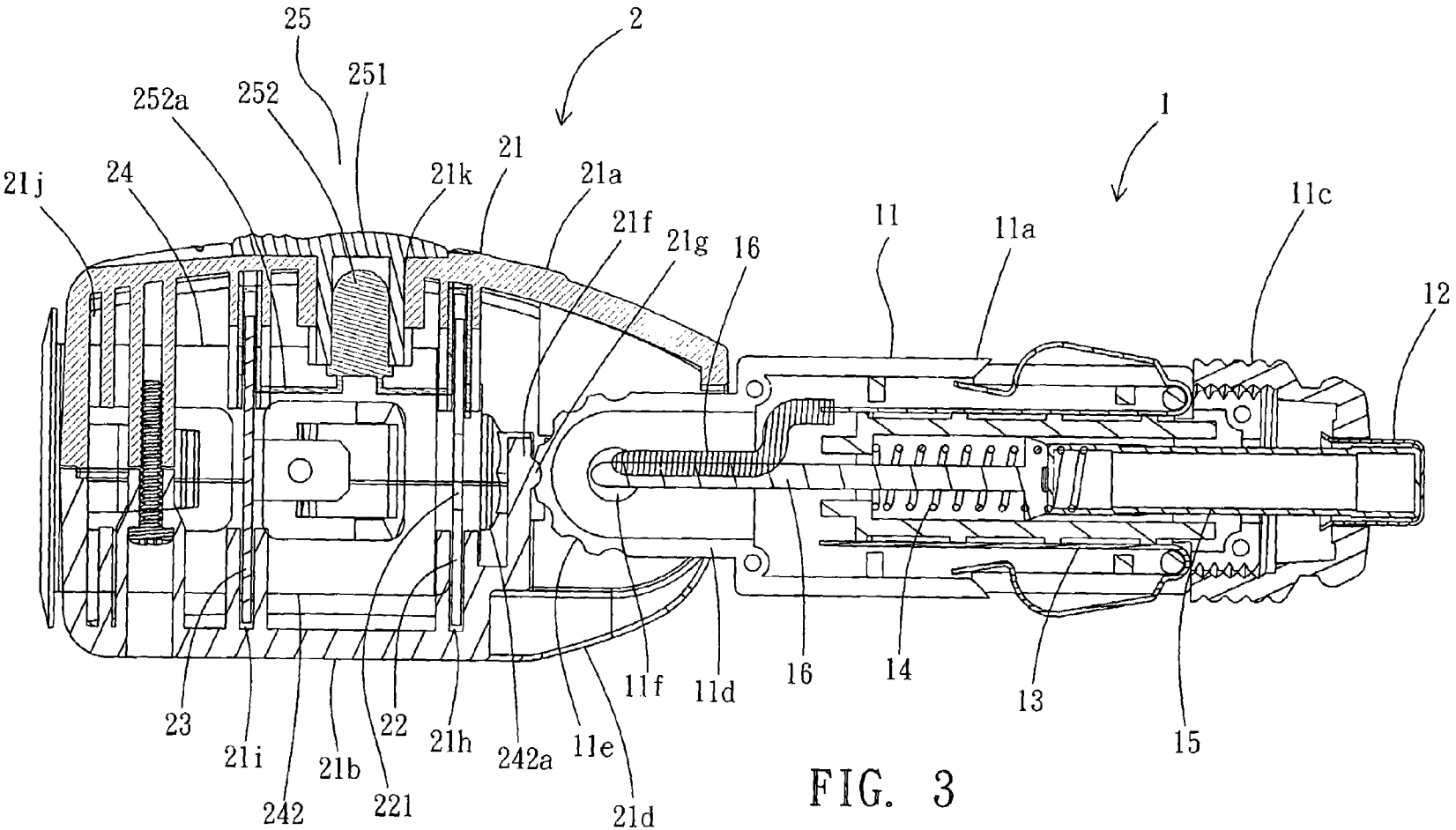
FIG. 3 schematically illustrates a cross-sectional view of a multi-accessory adaptor for a vehicle after assembly according to the present invention.

With reference to FIGS. 1 to 3, the multi-accessory adaptor for vehicle comprises a power plug portion 1, and a socket portion 2.

The power plug portion 1 includes a cylindrical inserting rod 11, as shown in the figures, formed by connecting two semi-circular covers 11*a* and 11*b* face-to-face and a plastic cover 11*c* sealing the opening the connected covers. The size of the inserting rod 11 dimensionally corresponds to the socket of the cigarette lighter with a positive inserting pole 12 protruding from its front end cover 11*c* and two negative spring plates 13 disposed on its opposing sides and penetrating therethrough. The negative spring plates 13 can be retained within the aforementioned connector socket by their spring force, which is a conventional art and will not be discussed here further. The rear end of the inserting rod 11 is connected to an axial connection mechanism, as shown in the figures, comprising an axial connection plate 11*d* at the rear end of the inserting rod 11 with its external edge forming a plurality of engaging slots 11*e* on its side protruding laterally to form an axial tube 11*f* to be pivotally connected with the socket portion 2 and bended to a desired angle to suit the actual need.

The positive inserting pole 12 and a metal resilient body 14, a spring for example, are disposed with a fuse 5 therebetween to avoid overloading. Also, the metal resilient body 14 and one negative spring plate 13 are connected with a connection cord 16, respectively, penetrating through an axial tube 11*f* and in turn into the socket portion 2 to supply the power required.

The socket portion 2 is a hollow housing 21, as shown in the figures, comprising two housing cover 21*a* and 21*b* connected face-to-face, which is to axially connect the inserting rod 11 and to accommodate and retain at least two cylindrical sockets 24 described later.

The front end of the housing 21 is disposed with a pivoting mechanism to be axially connected to the front end of the inserting rod 11, wherein a slot 21*d* is disposed between the two axial walls 21*c* on the front center of the lower housing cover 21*b* for the insertion of the axial connection plate 11*d* and for the straddling of the lateral axial tube 11*f* onto the two axial slots 21*e* pre-formed on the two axial walls 21*c*, such that the whole the inserting rod 11 may move in an arcuate manner in front of the housing 21. Furthermore, to provide the inserting rod 11 with the functions of arresting and engaging when swinging, the rear of the two axial walls 21*c* are vertically disposed with a stop wall 21*f* and their front is protrudingly disposed with an engaging tenon 21*g* (shown in FIG. 3) to be engaged with one of the engaging slot 11*e* of the axial connection plate 11*d* so as to ensure the retainment and stability of the angle adjustment.

To provide the retainment of the positive plate 22 and the negative plate 23, the front and rear inner walls of the upper housing 21*a* and the lower housing 21*b* are formed to have a front inserting slot 21*h* and rear inserting slot 21*i*, respectively, to clampingly accommodate the positive plate 22 and the negative plate 23 so as to achieve retainment, wherein the positive plate 22 and the negative plate 23 are coupled with the positive and negative cords 16, respectively. Furthermore, the negative plate 23 on the rear end of the socket portion 2 are shaped to form a certain number of circular plate hole 231 corresponding to the required number of the cylindrical socket 24 for the insertion of the cylindrical socket 24.

As shown in the figures, for the embodiment of the cylindrical sockets 24, they may all be in the shape of short circular tube 241, or one of them is the existing cigarette lighter socket assembly 242 and the rest are short circular tube 241. Consequently, the design allows the insertion of different power plugs, or one is for the cigarette lighter and the rest are for other power plug. The flexible selection of the cylindrical socket 24 will not be discussed here further. In face, the rear opening of the short circular tube 241 protrudes to form a rim 241*a*, which can be clampingly accommodated within the rear opening 21*j* of the housing 21. On the other hand, the cigarette lighter socket assembly 242 may pass through the plate hole 231 and its connection portion 242 on its front end is connected to the through hole 221 pre-formed on the positive plate 22 so as to achieve a secured fastening.

Furthermore, the present invention further comprises a display device 25, wherein the upper housing 21*a* is shaped to form a through hole 21*k* for the insertion of a light channeling seat 251 in a bulb shape and then a light 252, a LED light or more specifically a multi-color LED light, is pressed to be retained in the light channeling seat 251 with its two legs 252*a* bended and straddled on the positive plate 22 and negative plate 23, respectively, such that the light 252 will be lit on when any one of the cylindrical sockets 24 is connected to a power plug for power, indicating that it is in a closed circuit state. Furthermore, the light display device 25 has a decorating effect as well.

Figure 4:
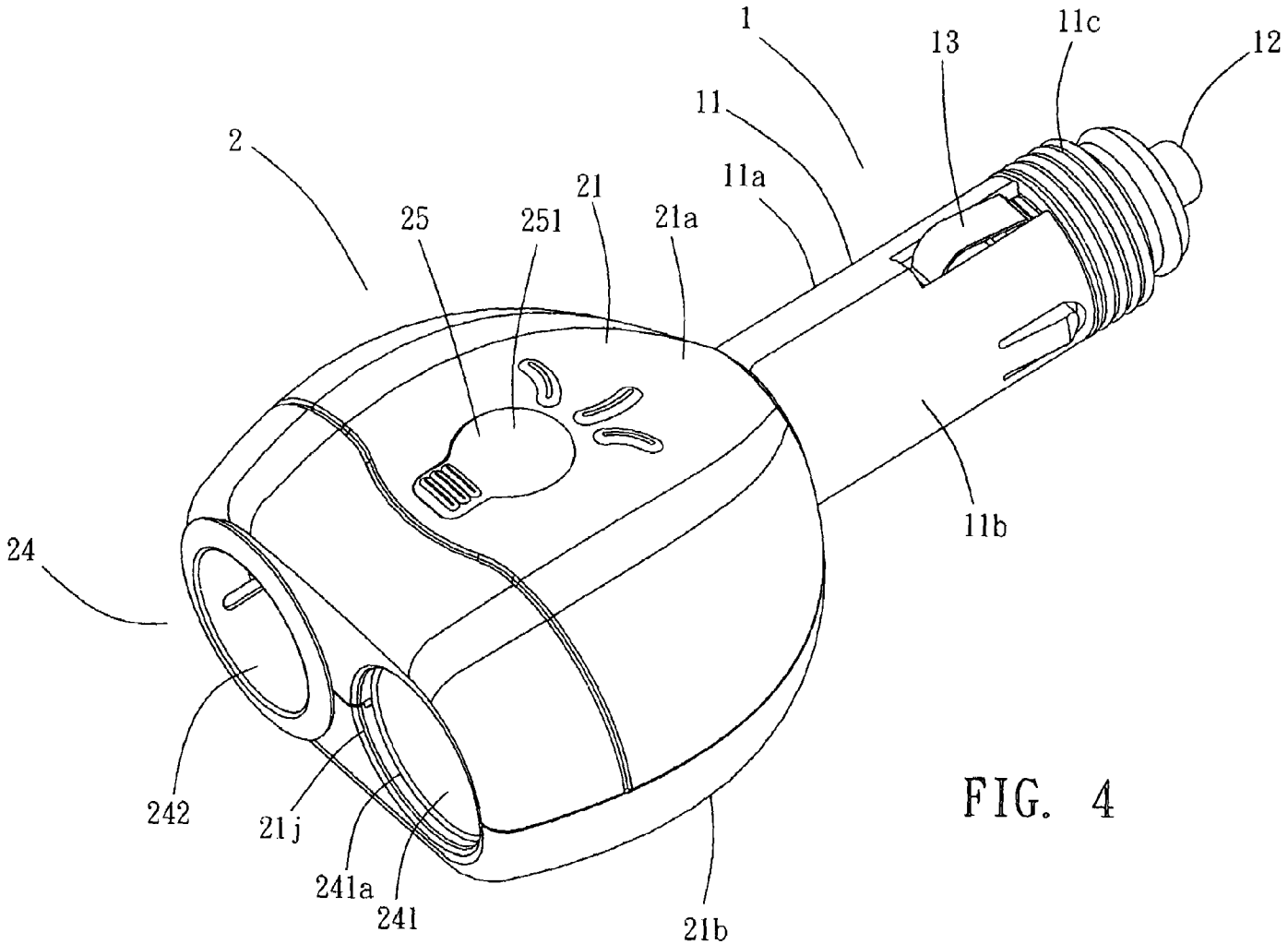
FIG. 4 schematically illustrates a perspective assembly view of a multi-accessory adaptor for a vehicle according to the present invention.
Figure 5A:
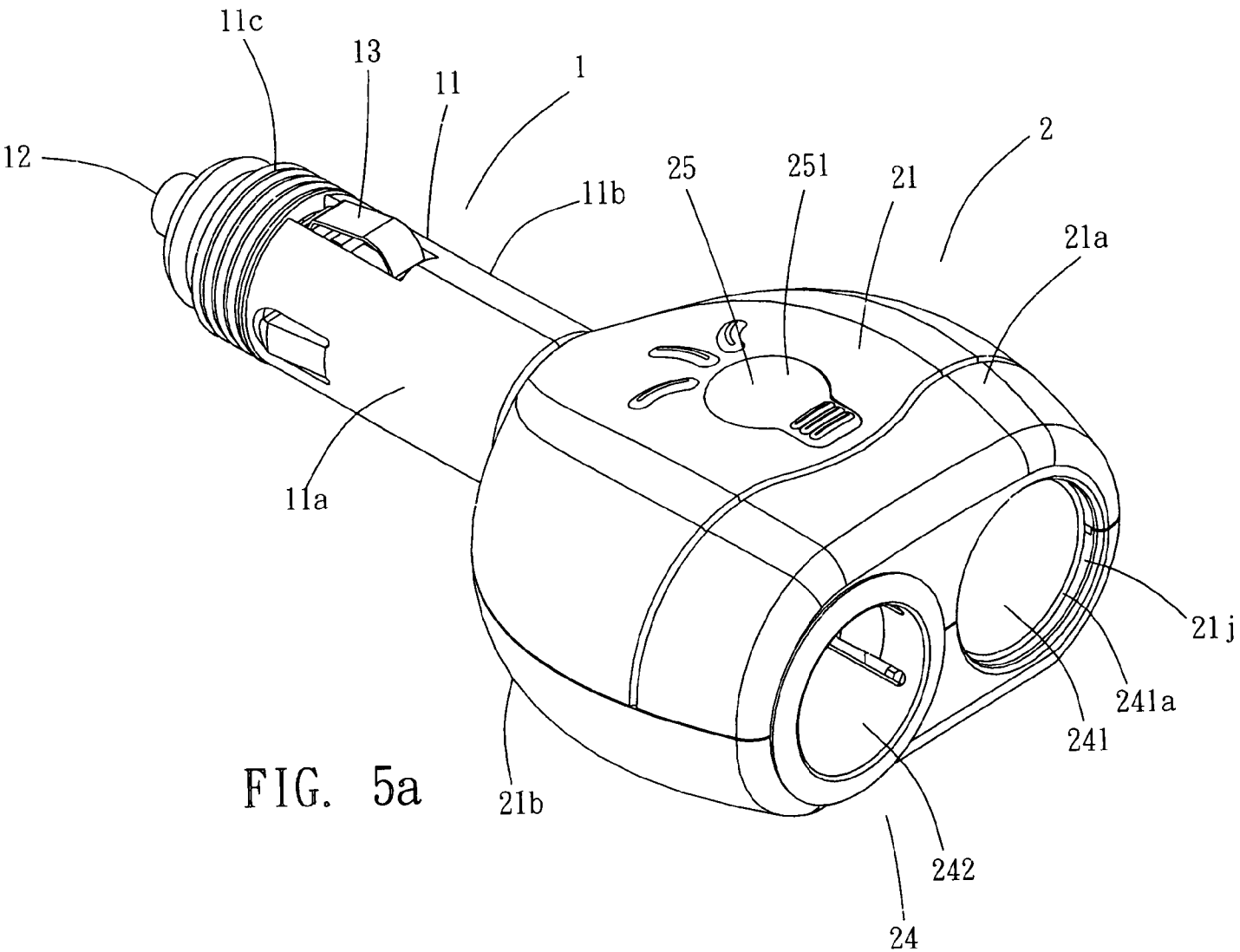
FIGS. 5*a* to 5*d* schematically illustrate perspective views of adjusting the angle of the power plug portion according to the present invention.
Figure 5B:
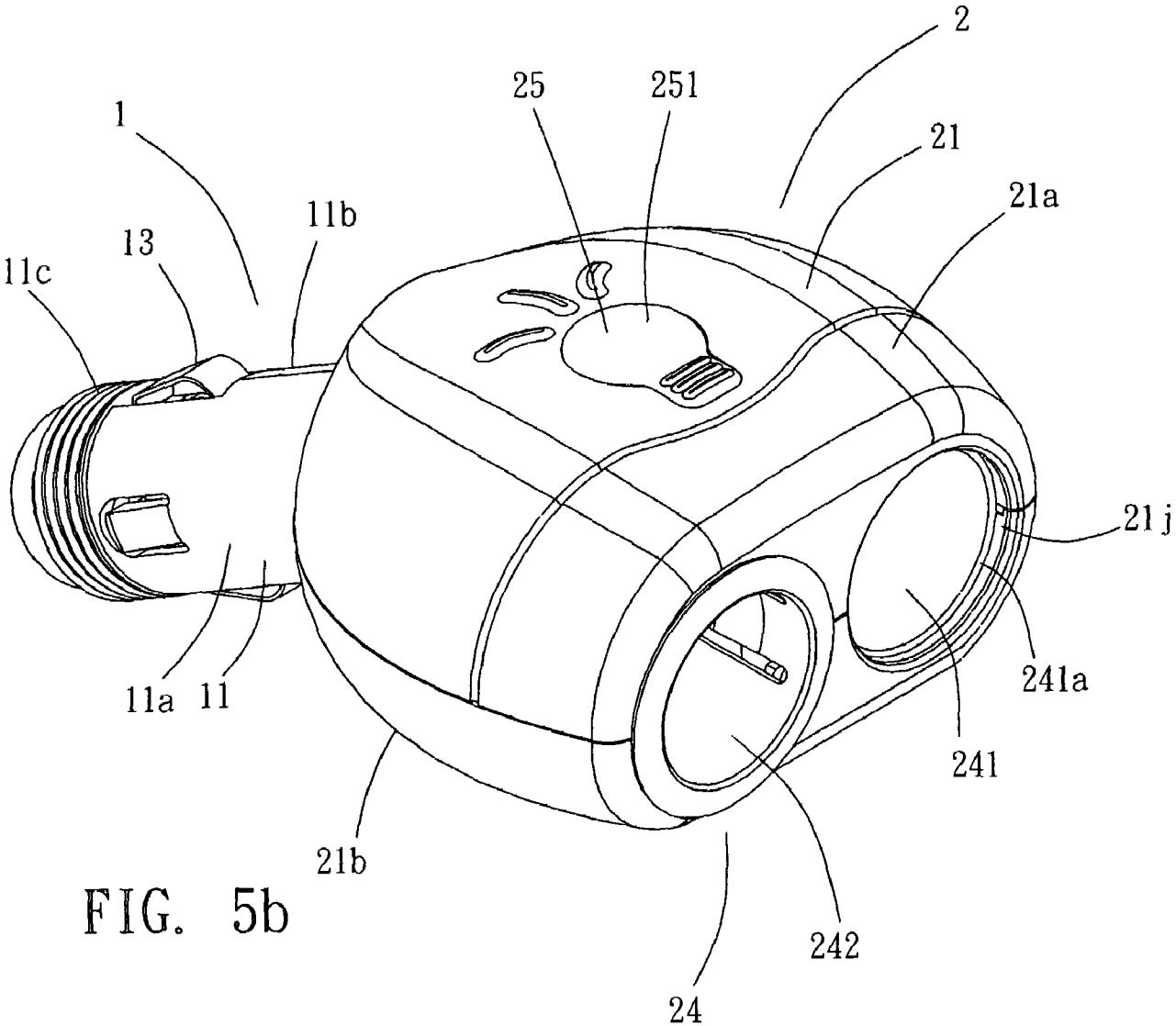
Figure 5C:
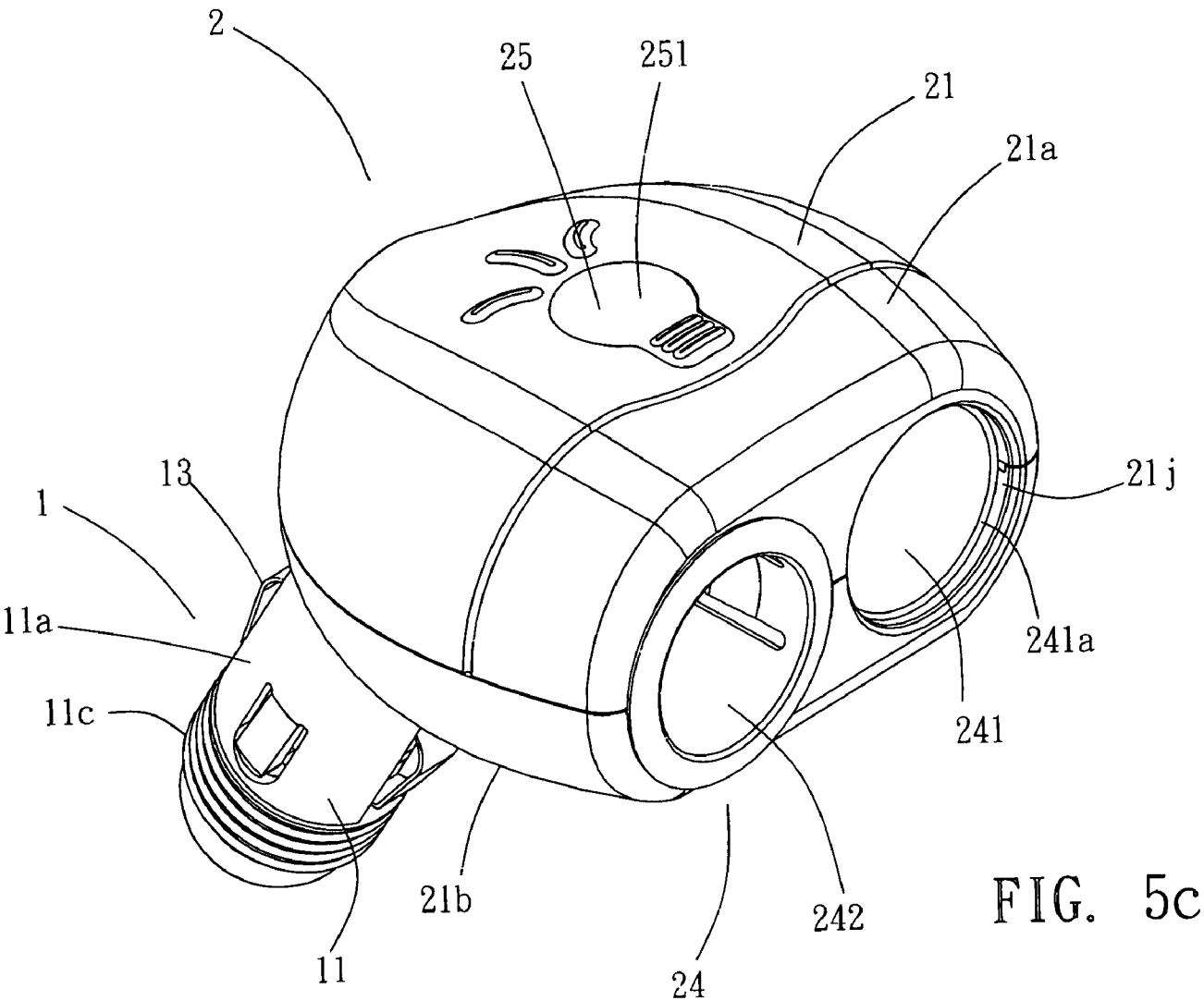
Figure 5D:
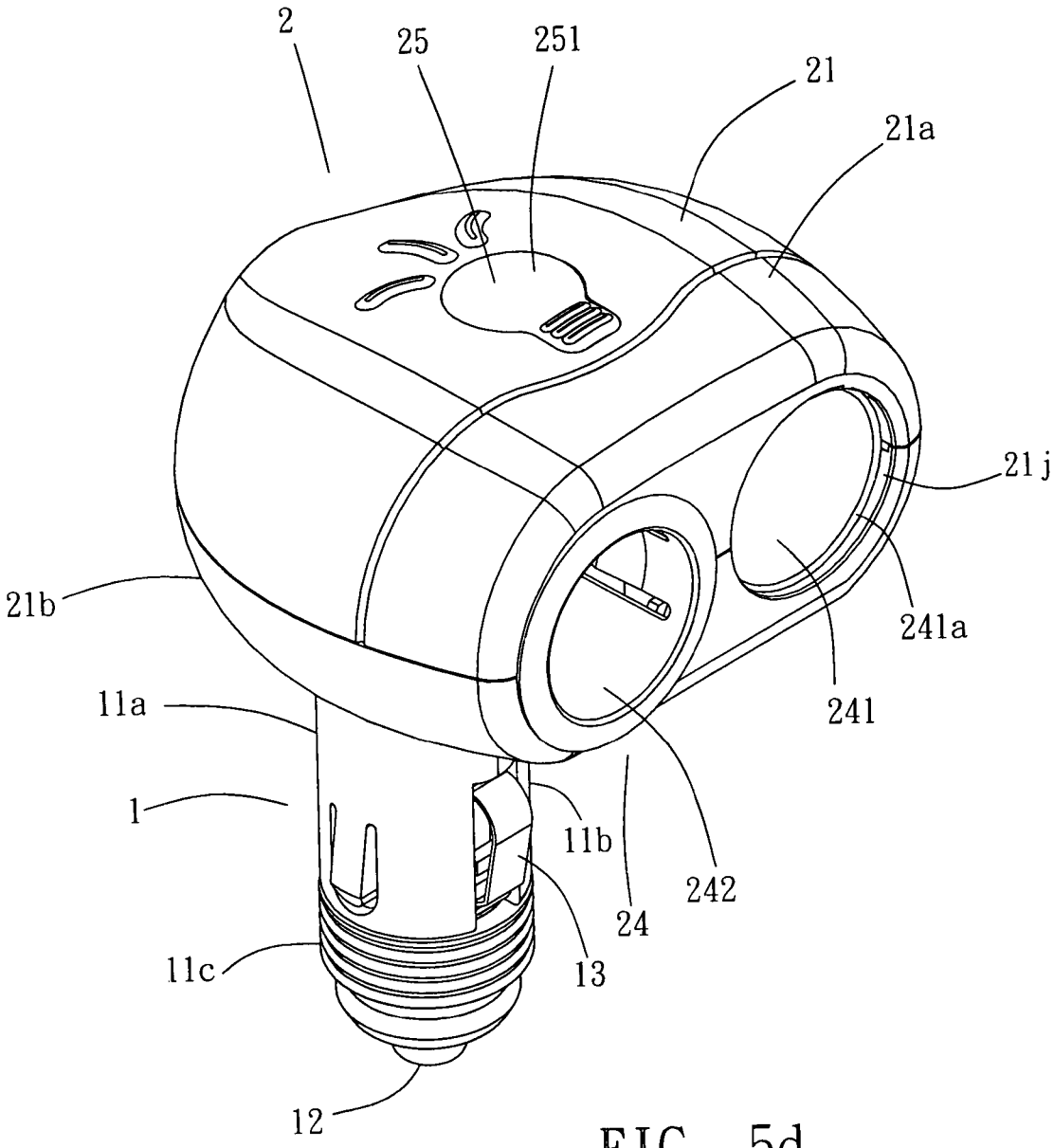

With the aforementioned descriptions concerning the components and their relative configurations, the present invention is shown in FIG. 4 after assembly. When others articles in the vehicle may be hindered by the presence of the socket portion 2, the hindrance may be avoid by swinging the inserting rod 11, as show in FIGS. 5*a* to 5*d*, to render its engaging slot 11*e* selectively engaged with the engaging tenon 21*g* and thus to change the angle between the power plug portion 1 and the socket portion 2.

Consequently, with the implementation of the present invention, the power connection portion and the socket portion are integrated as one with their angular configuration may be adjusted, such that at least two cylindrical sockets may be securingly accommodated within the socket portion. Furthermore, the angle between the power plug portion and the socket portion may be adjusted so that the present invention can be placed at a desired angle to avoid hindering the driver or passengers and to conform to ergonomics. Furthermore, the present invention renders the cigarette lighter socket to supply power to both the cigarette lighter and other power plug so as to simplify the welding process and thus to reduce pollution, simply assembly process, and cut down manufacturing cost, which is indeed one of its kind.

While the invention has been described with reference to the a preferred embodiment thereof, it is to be understood that modifications or variations may be easily made without departing from the spirit of this invention, which is defined by the appended claims.

What is claimed is:

1. A multi-accessory adaptor for a vehicle comprising:

a power plug portion, which is a cylindrical inserting rod disposed with a positive inserting pole protruding from its front end cover and two negative spring plates on its opposing sides and penetrating therethrough, and a connection cord is connected to the positive and negative poles, respectively, and protrudes out from the rear of the inserting rod; and a socket portion, which is a hollow housing with its front and rear inserting slots for the insertion and retainment of the positive and negative plates, respectively, the positive and negative plates coupled with their corresponding connection cords, and the negative plate on a rear end of the socket portion are shaped to form at least two plate holes for the insertion of their corresponding cylindrical sockets which are then secured at the rear opening of the hollow housing.

2. The multi-accessory adaptor for a vehicle as claimed in claim 1, wherein the cylindrical inserting rod is formed by connecting two semi-circular covers face-to-face and a metal cover sealing the opening the connected covers; the housing is formed by connecting two housing covers face-to-face.

3. The multi-accessory adaptor for a vehicle as claimed in claim 1, wherein the rear end of the inserting rod extends to form an axial connection mechanism and the front end of the housing is disposed with a pivoting mechanism to be axially connected to the axial connection mechanism, such that the inserting rod may be angularly adjusted with respect to the housing.

4. The multi-accessory adaptor for a vehicle as claimed in claim 3, wherein the axial connection mechanism is an axial connection plate at the rear end of the inserting rod with its external edge forming a plurality of engaging slots on its side protruding laterally to form an axial tube; and the pivoting mechanism is disposed with a slot between the two axial walls on the front center in the lower housing cover for the insertion of the axial connection plate and for the straddling of the lateral axial tube onto the two axial slots pre-formed on the two axial walls, and the rear of the two axial walls are vertically disposed with a stop wall and their front is protrudingly disposed with an engaging tenon to be engaged with one of the engaging slot of the axial connection plate.

5. The multi-accessory adaptor for a vehicle as claimed in claim 4, wherein the positive inserting pole and the negative spring plate are connected with a respective connection cord, which penetrates through the laterally axial tube of the axial connection plate.

6. The multi-accessory adaptor for a vehicle as claimed in claim 1, wherein the positive inserting pole and a metal resilient body at its rear are disposed with a fuse therebetween and the metal resilient body is further coupled with a connection cord.

7. The multi-accessory adaptor for a vehicle as claimed in claim 1, wherein the cylindrical sockets may all be in the shape of short circular tube, or one of them is the existing cigarette lighter socket assembly and the rest are short circular tube.

8. The multi-accessory adaptor for a vehicle as claimed in claim 7, wherein the rear opening of the short circular tube protrudes to form a rim, which can be clampingly accommodated within the rear opening of the housing, and the cigarette lighter socket assembly may pass through the plate hole and its connection portion on its front end is connected to the through hole pre-shaped on the positive plate so as to achieve a secured fastening.

9. The multi-accessory adaptor for a vehicle as claimed in claim 1, further comprising a display device having a through hole on the for the insertion of a light channeling seat and then a lighting device pressed to be retained in the light channeling seat with its two legs bended and straddled on the positive plate and negative plate, respectively, to form a closed circuit.

10. The multi-accessory adaptor for a vehicle as claimed in claim 9, wherein the lighting device may be a single LED light or a multi-color LED light.

* * * * *